US006418872B1

(12) United States Patent
Cour

(10) Patent No.: US 6,418,872 B1
(45) Date of Patent: Jul. 16, 2002

(54) UNDERWATER EXPLORATION DEVICE

(75) Inventor: Francis Cour, Maisons-Laffitte (FR)

(73) Assignee: Fugro France, Cedex (FR)

( * ) Notice: Subject to any disclaimer, the term of this patent is extended or adjusted under 35 U.S.C. 154(b) by 0 days.

(21) Appl. No.: 09/554,720

(22) PCT Filed: Sep. 21, 1999

(86) PCT No.: PCT/FR99/02236

§ 371 (c)(1),
(2), (4) Date: May 18, 2000

(87) PCT Pub. No.: WO00/17043

PCT Pub. Date: Mar. 30, 2000

(30) Foreign Application Priority Data

Sep. 21, 1998 (FR) ..... 98/11730

(51) Int. Cl.[7] ..... B63G 8/00
(52) U.S. Cl. ..... 114/312; 114/253; 114/254
(58) Field of Search ..... 114/253, 254, 114/312; 254/336

(56) References Cited

U.S. PATENT DOCUMENTS

| | | | | |
|---|---|---|---|---|
| 3,275,097 A | | 9/1966 | Pavey | |
| 3,398,715 A | | 8/1968 | Burg | 114/235 |
| 3,549,129 A | | 12/1970 | Graham et al. | 254/172 |
| 3,580,133 A | * | 5/1971 | Berthiez | 409/237 |
| 4,314,363 A | | 2/1982 | Thigpen et al. | 367/16 |
| 5,042,415 A | | 8/1991 | Hoffman | 114/322 |

FOREIGN PATENT DOCUMENTS

| | | |
|---|---|---|
| EP | 0 677 753 | 10/1995 |
| FR | 2 611 917 | 9/1988 |

* cited by examiner

*Primary Examiner*—Stephen Avila
(74) *Attorney, Agent, or Firm*—Duane Morris LLP

(57) ABSTRACT

A device for performing yo-yo seismic shooting on the sea bed by means of a sled. An umbilical traction cable connecting the vessel to this sled passes over a set of sheaves whose relative distances apart are controlled by an actuator enabling a determined length of cable to be let out or to be taken in so as to obtain discontinuous movement of the sled.

4 Claims, 2 Drawing Sheets

UNDERWATER EXPLORATION DEVICE

The present invention relates to a device for underwater exploration or geophysical reconnaissance intended in particular but not exclusively for yo-yo seismic shooting.

BACKGROUND OF THE INVENTION

Yo-yo seismic shooting is an operation during which the tool on the sea bed, on a sled, needs to be kept stationary for the length of time required to perform its operations while a surface vessel continues to advance at constant speed, with the tool or the sled being connected to the vessel by a cable. It is thus a question of transforming the continuous motion of the vessel into motion of the vehicle towed along the sea bed that is discontinuous, although cyclical. It thus possible to obtain the information required at some determined pitch. This operation is commonplace and it requires the tool-and-sled vehicle to remain stationary for a certain length of time, and then, on being raised, to be moved and again held stationary. That is to say it proceeds in jumps.

The solution presently in use consists in winding the cable on a special "yo-yo" winch. The winch ensures that the towed vehicle moves in discontinuous manner, and it suffers from major drawbacks associated with the technical specifications associated with yo-yo type operations: paying out speed of several meters per second, accurate monitoring of the length of cable paid out, instantaneous traction forces, accurate servo-control to maintain the rate, etc. The winches usually installed on surface vessels do not comply with these specifications. Special winches therefore need to be manufactured and secured on vessels, thereby giving rise to constraints that are expensive in terms of cost and in terms of on-site operations. Furthermore, such winches are heavy and bulky.

OBJECTS AND SUMMARY OF THE INVENTION

A first object of the invention is to mitigate that drawback and to enable yo-yo type operations to be performed without recourse to using a specialized winch.

U.S. Pat. No. 3,549,129 describes apparatus mounted on the deck of a ship and designed to compensate the effects of relative movement between a surface vessel subjected to swell and an operational device that must be kept at constant level. That apparatus includes a pantograph and operates continuously, but compensates movements of small amplitude only.

According to the invention, the yo-yo apparatus comprises a link cable between a surface vessel (N) advancing at substantially constant speed and a sea bed sled (T), the cable being wound on a winch mounted on the deck of the vessel, wherein a block-and-tackle unit is located on the deck between the winch and the vehicle, the block-and-tackle unit being fixed to a frame for letting out and taking in the length of cable required to enable the sled to move in jumps.

According to another characteristic of the invention, the block-and-tackle unit is constituted by two sets of sheaves over which the cable passes, a first set of sheaves being fixed, and the other set being capable of being moved away from or towards the first set under drive from an actuator fixed on the block-and-tackle unit frame.

The block-and-tackle unit actuated by an actuator enables the cable recovery and release operations to be performed quickly at the desired moments.

BRIEF DESCRIPTION OF THE DRAWINGS

Other characteristics and advantages of the invention will appear on reading the following description of particular embodiments, given purely by way of non-limiting example, and with reference to the drawings which show.

MORE DETAILED DESCRIPTION

In the figures, the same references are used to designate the same elements.

Figure 1:
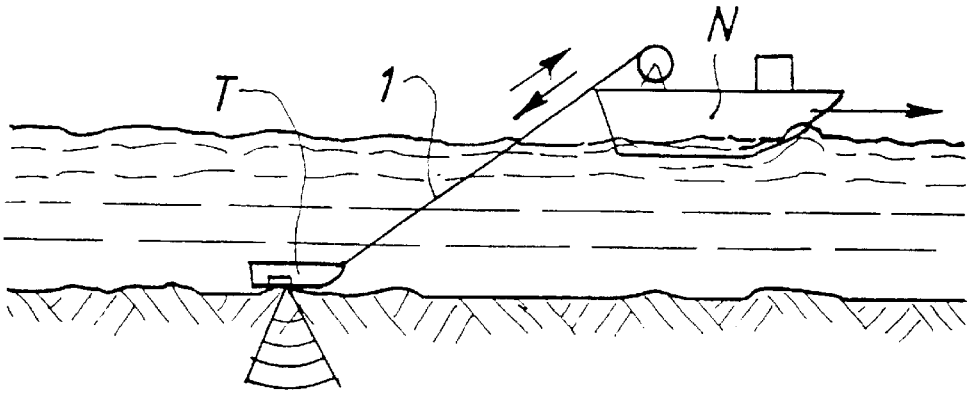
FIG. 1 is a diagrammatic view of a vessel towing a sea bed vehicle.

FIG. 1 is a diagram applicable to the prior art showing a vessel N fitted with a winch on which there is wound an umbilical traction and transmission cable 1 which tows a sled T that is located on the sea bed and that has previously been fitted with geophysical measurement apparatuses such as transceivers, for example.

Figure 2:
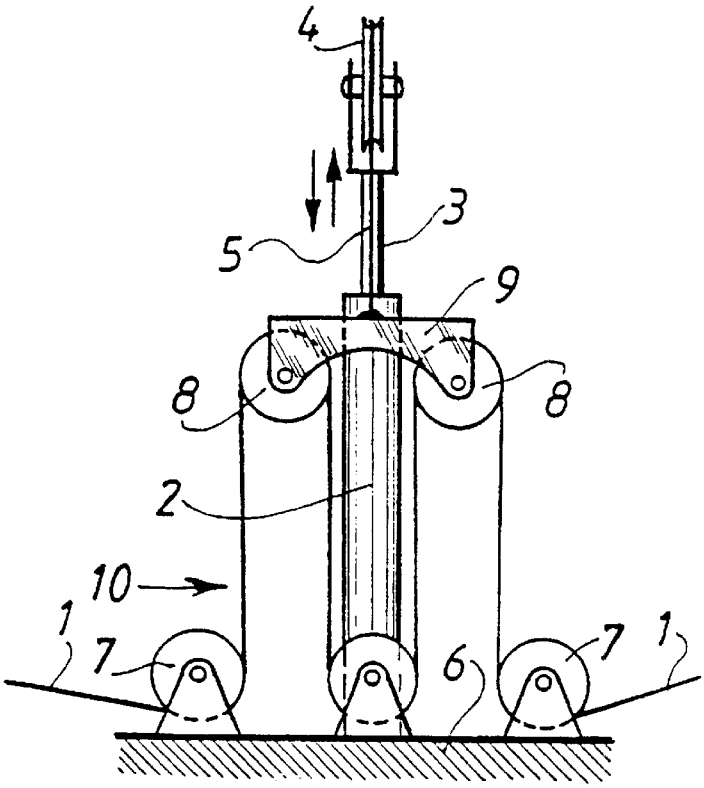
FIG. 2 is a front view of the system of sheaves constituting a block-and-tackle unit.
Figure 3:
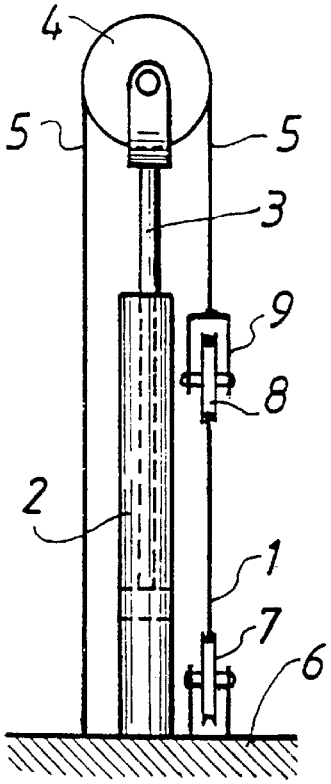
FIG. 3 is a side view of the same block-and-tackle unit.

In accordance with the invention, the cable 1 is caused to pass through apparatus of the kind shown in FIGS. 2 and 3 constituted by a block-and-tackle unit given overall reference 10. The apparatus includes an actuator 2 whose cylinder is secured to the deck of the vessel and whose rod carries a sheave 4. The sheave 4 has a cable 5 passing thereover, which cable has one of its ends fixed to the frame 6 that supports both a bottom set of sheaves 7 and a top set of sheaves 8, and which in the example shown amount to five sheaves over which the cable 1 passes. The sheaves 7 are fixed to the frame 6 whereas the sheaves 8 are rotatably received in a yoke 9 which is carried by the free end of the cable 5.

The actuator 2, 3 can be of any type suitable to the specification in terms of stroke and force and is preferably a hydraulic or pneumatic actuator enabling its rod to be displaced quickly, thereby displacing the cable quickly.

Operation is as follows. While the rod 3 is moving out from the actuator, the two sheaves 8 pulled by the cable 5 move away from the three bottom sheaves 7 that are fixed to the frame 6 of the actuator. This has the effect of pulling in a length of traction cable 1 equal to the stroke of the piston multiplied by the velocity ratio of the system. In the example shown, this ratio is 8 since it is the result of the ratio applicable to the cable 5 (a ratio of 2) and that of the block-and-tackle unit (a ratio of 4). During the subsequent stage of retracting the rod into the actuator, the traction cable 1 is released over a length equal to the stroke of the rod multiplied by the same velocity ratio. The block-and-tackle unit thus acts, so to speak, as a buffer memory for the cable 1 and in order to raise or put down the sled on the sea bed, it suffices to actuate the actuator.

Figure 4:
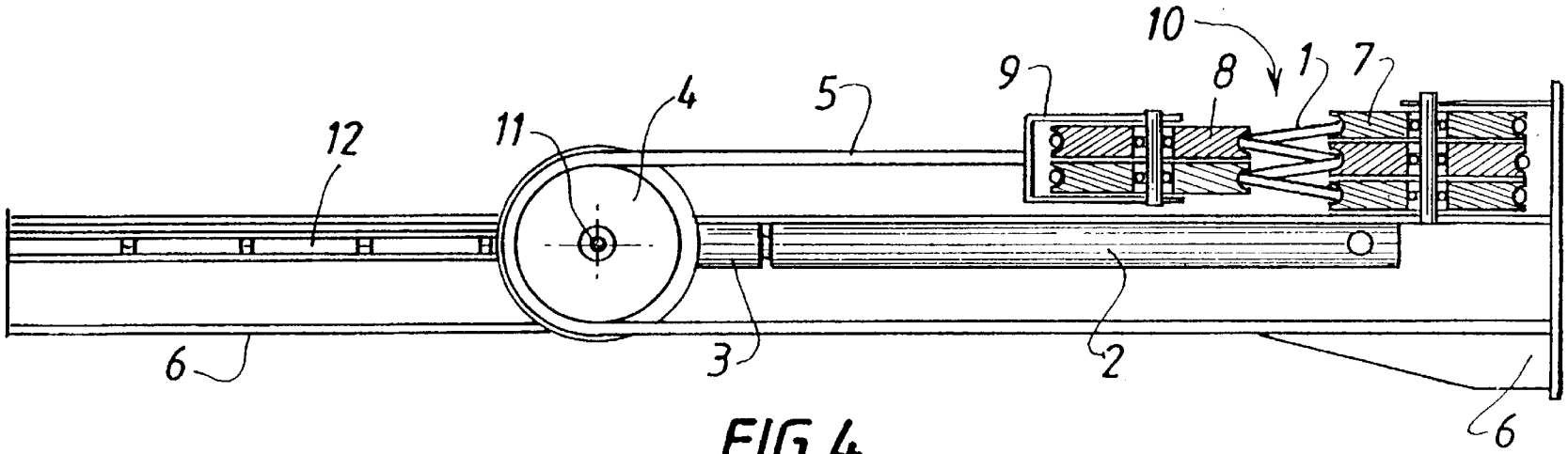
FIGS. 4 and 5 are views of the actuator whose rod is shown respectively in its retracted position and in its extended position.
Figure 5:
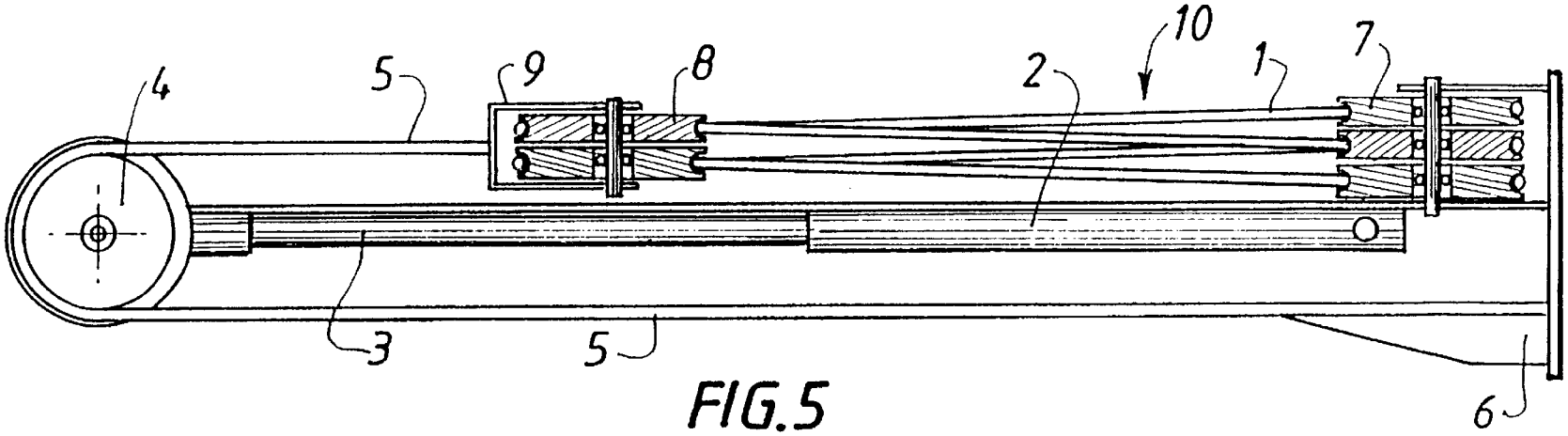

FIG. 4 shows the rod 3 of the actuator in its retracted position and FIG. 5 shows the same rod in its extended position together with the corresponding positions of the various members mentioned above. As can be seen in FIG. 4, the axis of the sheave 4 is guided in the frame 6 by a slideway 12.

By way of example, the five sheaves 7, 8 mentioned above, for a rod having a stroke of 75 cm, give the cable 1 a stroke 6 meters (8×75 cm). If the travel speed of the rod is 50 cm/s, then the speed at which the cable 1 is paid out or wound in is 8×0.5, i.e. 4 meters per second.

Naturally, numerous variants can be provided, in particular by substituting equivalent technical means, without thereby going beyond the ambit of the invention.

What is claimed is:

1. A device for providing yo-yo seismic shooting, the device comprising a cable for connecting a surface vessel advancing at substantially constant speed and a sea bed sled, the cable being wound on a winch mounted on the deck of the vessel, a block-and-tackle unit including a frame being located on the deck between the winch and the sled, wherein the block-and-tackle unit is fixed to the frame for letting out and taking in the length of cable necessary to enable the sled to be moved in jumps, the block-and-tackle unit being constituted by two sets of sheaves over which the cable passes, a first set of sheaves being fixed on the block-and-tackle unit while the second set of sheaves is capable of being moved away from or towards the first set of sheaves by an actuator fixed to the frame, wherein the device is operable for letting out and taking in a length of the cable repetitively so as to move a payload in jumps for yo-yo seismic shooting.

2. A device for providing yo-yo seismic shooting, the device comprising a cable for connecting a surface vessel advancing at substantially constant speed and a sea bed sled, the cable being wound on a winch mounted on the deck of the vessel, a block-and-tackle unit being constituted by a first and second set of sheaves and including a frame being located on the deck between the winch and the sled, wherein the second set of sheaves is supported by a jack having a cylinder and a rod with a free end, the cylinder being fixed on the frame, an idle sheave being mounted on a free end of the rod, a cable passing around said idle sheave being attached at one end to the frame and at the other end to a yoke supporting the second set of sheaves.

3. In combination, a surface vessel operable to advance at substantially constant speed over a sea bed, a sled coupled to the vessel by a cable, a device operable alternately to pay out the cable at least at said constant speed such that the sled is stationary while the vessel continues to advance, and to retract the cable at a speed faster than the constant speed such that the sled is advanced over the sea bed toward the vessel while the vessel continues to advance, the device comprising a block-and-tackle unit located on the vessel, the block-and-tackle unit having at least two sets of sheaves over which the cable passes, and an actuator operable alternately to move the sets of sheaves toward and away from one another, such that a length of the cable is alternately paid out by the block and tackle unit and accumulated between the sheaves, and wherein the length of cable is sufficient to advance the sled in a yo-yo manner as the vessel advances.

4. The combination of claim 3, therein said actuator comprises a jack having a cylinder and a rod with a free end, the cylinder being fixed on a frame on a deck of the vessel to which one of said sets of sheaves is mounted, further comprising an idle sheave mounted on a free end of the rod, an actuator cable passing around said idle sheave and being attached at one end to the frame and at an other end to a yoke supporting another of said sets of sheaves, such that displacement of the rod by the cylinder is multiplied, thereby determining the length of cable that is alternately paid out and accumulated.

* * * * *